US005603885A

United States Patent [19]

McGinty

[11] Patent Number: 5,603,885

[45] Date of Patent: Feb. 18, 1997

[54] PROCESS FOR THE PREPARATION OF NONWOVEN FIBROUS SHEETS

[75] Inventor: David J. McGinty, Midlothian, Va.

[73] Assignee: E. I. Du Pont de Nemours and Company, Wilmington, Del.

[21] Appl. No.: 502,423

[22] Filed: Jul. 6, 1995

[51] Int. Cl.[6] ..... D01F 6/00

[52] U.S. Cl. ..... 264/205; 524/97; 524/100

[58] Field of Search ..... 524/100, 291, 524/153, 97; 523/347, 340, 333; 264/211.14, 211.15, 205, 211, 210.8

[56] References Cited

U.S. PATENT DOCUMENTS

| | | | |
|---|---|---|---|
| 3,081,519 | 3/1963 | Blades et al. | 28/81 |
| 3,851,023 | 11/1974 | Brethauer et al. | 264/24 |
| 4,086,204 | 4/1978 | Cassandrini et al. | 524/100 |
| 4,104,248 | 8/1978 | Cantatore | 524/100 |
| 4,108,829 | 8/1978 | Cantatore et al. | 524/100 |
| 4,183,881 | 1/1980 | Griffin et al. | 264/205 |
| 4,187,212 | 2/1980 | Zinke et al. | 524/153 |
| 4,590,231 | 5/1986 | Seltzer et al. | 524/100 |
| 4,668,721 | 5/1987 | Seltzer et al. | 524/95 |
| 4,876,300 | 10/1989 | Seltzer et al. | 524/100 |
| 5,149,774 | 9/1992 | Patel et al. | 528/492 |
| 5,318,735 | 6/1994 | Kozulla | 264/211.15 |
| 5,356,978 | 10/1994 | Garrison | 524/100 |

OTHER PUBLICATIONS

Vyprachtický et al "Possibilities for . . . A Review"—*Polymer Degradation and Stability* 27 (1990) 227–255, Elsevier Sci. Publ. Ltd. England.

*Primary Examiner*—Veronica P. Hoke

[57] ABSTRACT

A process for the preparation of plexifilament strands of polyethylene having a ultraviolet stabilizer, in which the polyethylene is dissolved in a non-chlorofluorocarbon solvent, which is pentane, and the ultra-violet stabilizer is selected from Chimassorb 119, Chimassorb 944, and Cyasorb UV 3346.

2 Claims, No Drawings

PROCESS FOR THE PREPARATION OF NONWOVEN FIBROUS SHEETS

FIELD OF THE INVENTION

This invention relates to the preparation of nonwoven fibrous sheets of flash spun polyethylene containing ultra-violet stabilizers where the flash spinning is from a solution of the polyethylene in hydrocarbon, such as pentane.

BACKGROUND OF THE INVENTION

Flash spinning of polyethylene to form non-woven sheets is known in the art: see, for example, Brethauer et al., U.S. Pat. No. 3,851,023.

U.S. Pat. No. 4,086,204 discloses the use of Chimassorb 994 as a stabilizer for polyethylene.

Flash spun polyethylene nonwoven fibrous sheets containing an ultra-violet stabilizer are commercial products. The ultra-violet stabilizer is a necessary component of the product in that it protects both the nonwoven sheet from UV degradation, and other components, such as antioxidents, from UV degradation. Most of the commercial flash spun products are made by spinning the polyethylene containing ultra-violet stabilizer from a chlorofluorocarbon solvent, such as trichlorofluoromethane. Such solvents are known to react with atmospheric ozone, therefore, considerable effort has been expended to minimize the release of such solvents to the atmosphere, and alternative solvents have been sought.

One alternative solvent is pentane. However, when pentane is substituted for chlorofluorocarbon solvents when spinning polyethylene containing the ultra-violet stabilizer commonly used, another problem arises: namely, "dust" forms at the spinning nozzle, and dust deposits cover the apparatus and product. Chemical analysis of the "dust" has shown that it is primarily the ultra-violet light stabilizer.

An object of the invention is to provide a process for flash spinning polyethyene containing a ultra-violet stabilizer from pentane where the level of "dust" is at least as low as the dust level when the solvent is a chlorofluorocarbon.

SUMMARY OF THE INVENTION

The present invention is a process for the production of plexifilamentary strands of polyethylene which comprises (a) forming a solution of polyethylene, an antioxidant, and a ultra-violet light stabilizer, in hydrocarbon, such as pentane, and while the solution is under high pressure, (b) extruding said solution into a zone of lower pressure where the solution forms a two-phase mixture of pentane dispersed in a polymer-rich phase, (c) then passing the two-phase mixture into a zone of still lower pressure where the pentane vaporizes and plexifilamentary strands of polyethylene are formed, said ultra-violet light stabilizer being a high molecular weight hindered amine having a narrow molecular weight distribution, a high solubility in the polymer-rich phase, a high resistance to hydrolysis under the condition of the process, and being selected from the group consisting of (a) Chimassorb 119: i.e., N,N'''-[1,2-ethanediylbis[[[4,6-bis [butyl (1,2,2,6,6-pentamethyl-4-piperidinyl) amino]-1,3,5-triazin-2-yl]-3,1-propanediyl]]bis[N',N''-dibutyl-N'N''-bis (1,2,2,6,6-pentamethyl-4-piperidinyl)]-1,3,5,-triazine-2,4,6-triamine, (b) Chimassorb 944: i.e. poly ((6 ((1,1,3,3 -tetramethylbutyl) amino)-s-triazine-2,4-diyl) ((2,2,6,6-tetramethyl-4-piperidyl) imino) hexamethylene((2,2,6,6-tetramethyl-4-piperidyl) imino)), and (c) Cyasorb UV3346: i.e., poly[[6-(morpholino)-s-triazine-2,4-diyl][2,2,6,6-tetramethyl-4-piperidyl imino]].

In a preferred embodiment an antioxidant is present in the polyethylene, and is a highly preferred embodiment. The antioxidant is selected from the group consisting of Irganox 1010 Tetrakis[methylene (3,5-di-tert-butyl-4-hydroxyhydrocinnamate)]methane, and Irgafos 168 tris(2,4-di-tert-butylphenyl)phosphite.

DETAILED DESCRIPTION

An important use for flash spun polyethylene sheet is housewrap, which may be exposed to the sun for weeks or months during the construction of the house and then is expected to retain structural integrity for many years. The loss of structural integrity is mainly due to oxidative degradation but is accelerated greatly by UV light, which generates free radicals that attack the polyethylene sheet and simultaneously attack the antioxidant.

A commercial process for the production of flash spun nonwoven polyethyene sheets from a chlorofluorocarbon solvent utilizes Tinuvin 622 as a UV stabilizer. Tinuvin 622 is an oligomer of dimethyl succinate and N-beta-hydroxyethane-2,2,6,6-tetramethylpiperidine. The latter piperidine is also named: 4-hydroxy-2,2,6,6-tetramethyl-1-piperidineethanol. When this UV stabilizer was used in the preparation of nonwoven polyethylene sheets from pentane solvent, tests using Tinuvin 622 showed entirely unacceptable deposit formation, in the range of four times that of runs without the Tinuvin 622. Analysis showed that the deposits were extremely rich in relatively low molecular weight Tinuvin 622 (Tinuvin 622 is an oligimer with a relatively broad molecular weight distribution).

During flash spinning, the polymer and solvent are first in a homogeneous solution at high temperature (in the range of 160 to 200 degrees C) and at high pressure (in the range of 1700 to 2500 psi), then when pressure is reduced, the system splits into two phases. These are a polymer-rich phase (roughly 30% polymer and 70% solvent) and a solvent-rich phase (essentially 100% solvent and composing about 20–30% of the total solvent) that nucleates in small droplets uniformly throughout the polymer-rich phase. These droplets of solvent-rich phase flash off first on further pressure drop, and the vapor expansion is what creates the plexifilamentary structure. It is believed that when pentane is used as the solvent, significant amounts of the Tinuvin 622 migrated rapidly to the solvent-rich phase and were then cast off as dust when the solvent evaporated.

In order to solve this problem, it was necessary to find a UV stabilizer with significantly reduced solubility in the solvent-(pentane)rich phase and reduced ability to migrate to that phase during the brief period (400–700 milliseconds) of phase separation.

The invention here is the selection of UV stabilizers that have solubility and diffusion behavior that keeps the great majority of the stabilizer in the polymer-rich phase during phase separation and flash spinning so that deposits are minimized and the UV stabilizer is retained in the polymer where it can perform its designed function. This requires a stabilizer that is: 1) hydrolytically stable in the solution environment, 2) high molecular weight so that it cannot migrate rapidly from one phase to another, 3) monomeric so that it doesn't have low molecular weight fractions, 4) soluble in the polymer/solvent system, and 5) an effective UV stabilizer for the required end use.

Suitable UV stabilizers are: Chimassorb 119 and Chimassorb 944. Another compounds believed to be suitable is Cyasorb UV3346. The amount of UV stabilizer added to the polyethylene will usually be in the range of about 0.1 to about 1.0 percent by weight of the total. The preferred range is about 0.2 to 0.3 percent by weight of the total.

Usually the polyethylene will also contain an antioxidant. The amount of antioxidant will usually be in the range 0.1 to 0.5 percent by weight of the total. The preferred range is about 0.1 to 0.2% by weight of the total.

The polyethylene will usually be of high molecular weight, i.e., have a melt index in the range of about 0.6 to about 0.85 dg/min. Typically the melt index range will be about 0.7 to 0.8 dg/min.

Best mode contemplated: The UV stabilizer additive Chimassorb 119: N,N'''-[1,2-ethanediylbis[[[4,6-bis[butyl (1,2,2,6,6-pentamethyl-4-piperidinyl) amino]-1,3,5-triazin-2-yl]-3,1-propanediyl]]bis [N',N''-dibutyl-N',N''-bis(1,2,2,6,6-pentamethyl-4-piperidinyl)]-1,3,5-triazine-2, 4,6-triamine or Chimassorb 944: poly((6-((1,1,3,3-tetramethylbutyl)amino)-s-triazine-2,4-diyl) ((2,2,6,6-tetramethyl-4-piperidyl)imino) hexamethylene((2,2,6,6-tetramethyl-4-piperidyl)imino)) will be metered into the polymer pellets as they are conveyed to the extruder that will be used at the front end of the polymer solutioning system of the process. The additive can also be compounded into the polymer during the polymer manufacturing process by methods that are standard in the trade.

The Chimassorb 119 and Chimassorb 944 containing polymers used in the examples below were made by a polymer compounder who took pellets containing no UV stabilizer and added the UV stabilizer during a reextrusion process.

EXAMPLES

Control Example

Plexifilamentary polyethylene was flash-spun from a solution consisting of 20.0% of linear polyethylene and 80% of n-pentane. The solution was prepared in a continuous mixing unit and delivered at a temperature of 175° C., pressure of 2500 psi through a heated transfer line to an assembly of six spinneret packs. The flow rate of solution to each spin pack was 250 lb/hr. In each spin pack, the solution is forced from the transfer line through a pressure letdown chamber to a spinneret. The solution was delivered to the spinneret at 175° C. and flash-spun into a plexifilament at a rate equivalent to 50 lb/hr of polymer. The linear polyethylene had a melt index of 0.75 g/10 minutes and density 0.955 g/cc and contained the following additives: 1300 ppm Irganox 1010 tetrakis[methylene(3,5-di-tert-butyl-4-hydroxyhydrocinnamate)]methane, 500 ppm calcium stearate, and 1800 ppm Tinuvin 622. The additives were compounded into the polymer in a separate extrusion step prior to spinning. Spinning with this polymer produced a large amount of dust that deposited onto aerodynamic control and electrostatic charging surfaces creating nonuniformity in the product as it was laid down onto a collection belt. Some of the surfaces, which are normally nonconductive and develop a charge that repels the spun fibers, were made conductive by the deposits causing them to attract the spun fibers and create defects in the product. Web laydown and sheet uniformity were poor. Chemical analysis of the dust indicated that it contained up to 33% Tinuvin 622 and Tinuvin 622 degradation products. The amount of dust was measured to be 4 times higher than that formed when spinning with no Tinuvin 622.

Invention Example 1

In this Example the same polymer was spun as in the Control Example with the exception that 3550 ppm Chimassorb 119: N,N'''-[1,2-ethanediylbis[[[4,6-bis[butyl (1,2,2,6,6-pentamethyl-4-piperidinyl) amino]-1,3,5-triazin-2-yl]-3,1-propanediyl]]bis[N',N''-dibutyl-N',N''-bis(1,2,2,6,6-pentamethyl-4-piperidinyl)]-1,3,5-triazine-2, 4,6-triamine was used instead of 1800 ppm Tinuvin 622. Spinning with this polymer produced much less dust than the control example. The amount of dust produced was equivalent to that generated when spinning with no UV stabilizer. Web laydown and sheet uniformity were equivalent to that normally produced with no UV stabilizer and much superior to that in the control example.

Invention Example 2

In a third Example the same polymer as in the control Example was spun with the exception that 3600 ppm Chimassorb 944: Poly((6-((1,1,3,3-tetramethylbutyl)amino)-s-triazine-2,4-diyl) ((2,2,6,6-tetramethyl-4-piperidyl)imino) hexamethylene ((2,2,6,6-tetramethyl-4-piperidyl)imino)) was used instead of 1800 ppm Tinuvin 622. Dust generation, web laydown, and sheet uniformity were equivalent to that normally produced with no UV stabilizer and much superior to that in the control example.

What is claimed is:

1. A process for the production of plexifilamentary strands of polyethylene which comprises (a) forming a solution of polyethylene, an antioxidant, and an ultra-violet light stabilizer, in pentane, and while the solution is under high pressure, (b) extruding said solution into a zone of lower pressure where the solution forms a two-phase mixture of pentane dispersed in a polymer-rich phase, (c) then passing the two-phase mixture into a zone of still lower pressure where the pentane vaporizes and plexifilamentary strands of polyethylene are formed, said ultra-violet light stabilizer being a high molecular weight hindered amine having a narrow molecular weight distribution, a high solubility in the polymer-rich phase, a high resistance to hydrolysis under the condition of the process, and being selected from the group consisting of (a) N,N'''-[1,2-ethanediylbis [[[4,6 -bis [butyl(1,2,2,6,6 -pentamethyl-4-piperidinyl)amino]-1,3,5 -triazin-2-yl]-3,1-propanediyl]]bis [N',N''-dibutyl-N'N''-bis(1,2,2,6,6-pentamethyl-4-piperidinyl)]-1,3,5-triazine-2,4,6-triamine, (b) poly((6-((1,1,3,3-tetramethylbutyl) amino)-s-triazine-2,4-diyl)((2,2,6,6-tetramethyl-4-piperidyl)imino)hexamethylene((2,2,6,6-tetramethyl-4-piperidyl) imino)), and (c) poly[[6-(morpholino)-s-triazine-2,4-diyl][2,2,6,6-tetramethyl-4-piperidyl imino ]].

2. The process of claim 1 in which the antioxidant is selected from the group consisting of tetrakis [methylene(3,5-di-tert-butyl-4-hydroxyhydrocinnamate)]methane, and tris(2,4-di-tert-butylphenyl) phosphite.

* * * * *